United States Patent [19]

Gross

[11] 3,999,363

[45] Dec. 28, 1976

[54] TWIST-TUBE FOR FALSE-TWIST TEXTURING MACHINES

[75] Inventor: Hansrudolf Gross, Wattwil, Switzerland

[73] Assignee: Heberlein & Co. AG, Wattwil, Switzerland

[22] Filed: Jan. 30, 1975

[21] Appl. No.: 545,522

[30] Foreign Application Priority Data

| | | |
|---|---|---|
| Feb. 13, 1974 | Switzerland | 1987/74 |
| Jan. 9, 1975 | Switzerland | 222/75 |

[52] U.S. Cl. ..... 57/77.3; 228/254

[51] Int. Cl.[2] ..... D02G 1/06

[58] Field of Search ..... 57/77.3, 34 R, 77.45; 228/254

[56] References Cited

UNITED STATES PATENTS

| | | | |
|---|---|---|---|
| 3,232,036 | 2/1966 | Scragg | 57/77.3 |
| 3,349,554 | 10/1967 | Boutonnet | 57/77.3 |
| 3,574,273 | 4/1971 | Hilbert | 57/77.3 |
| 3,633,266 | 1/1972 | Taylor | 228/254 X |
| 3,711,628 | 1/1973 | Hansson | 228/254 X |
| 3,730,761 | 5/1973 | Smith | 228/254 X |
| 3,759,025 | 9/1973 | Takai | 57/77.3 |
| 3,778,991 | 12/1973 | Brummer | 57/77.3 |
| 3,842,581 | 10/1974 | Schedler | 57/77.3 |

*Primary Examiner*—Donald E. Watkins
*Attorney, Agent, or Firm*—Larson, Taylor and Hinds

[57] ABSTRACT

A twist tube for false-twist devices for texturing textile yarns is described wherein the thread guide pin has terminal portions coated with a solderable metal, such as nickel. The terminal portions are mounted in bores on each side of the elongated metal tubular part of the twist tube and at least one of the coated terminal portions is soldered into its associated bore at a temperature which does not modify the crystalline metal structure of the twist tube nor cause thermal deformation of the twist tube. The opposite terminal portion may be similarly soldered into its bore or it may be elastically mounted in its bore. Processes involving soft soldering and hard soldering are described.

8 Claims, 2 Drawing Figures

TWIST-TUBE FOR FALSE-TWIST TEXTURING MACHINES

FIELD OF THE INVENTION

The present invention relates to a twist tube for false-twist devices for texturing textile yarns and a process for the production of such a twist tube.

Twist tubes for false-twisting machines are known in the interior of which there is arranged a transverse thread-guide pin, the textile yarn to be textured, that passes through the longitudinal bore of the twist tube, being wound once around the pin. This pin consists of hard material, for example of sapphire or of ceramic material and is fixed in corresponding bores provided in the twist tube by adhesive material. This fixation has been sufficient for the requirements for a long time. The development of false-twisting machines for texturing textile yarns however tends to achieve higher and higher revolution speeds of the twist tube so as to increase the production of textured yarns. With the revolution speeds required nowadays, which lie far above 500,000 r.p.m., with the heating occurring in the twist tube, as well as centrifugal forces and vibrations, the use of adhesives is entirely insufficient since, after a relatively short time, destruction of the fixation of the thread guide pin takes place.

Numerous attempts have been made up to now to achieve permanent fixation of the thread-guides with special adhesives of high thermal resistance, by screwthreads or by laser welding but these have not yielded any useful results. It is certainly also known to fix ceramic parts without previous metallization of the same by hard soldering in a high vacuum. For this purpose, however, temperatures of approximately 960° C are necessary, which are much too high for the present purpose since the delicate, highly precise twist tube will thereby suffer deformation to such an extent as to make it unusable.

SUMMARY OF THE INVENTION

The object of the present invention consists in a twist tube and in a process for its production, which do not present the above-mentioned disadvantages and assure safe fixation of the thread-guide pins in the twist tubes which as a result resist substantially permanently thermal and mechanical stress occurring at high revolution speeds.

The twist tube according to the present invention comprises at least one thread-guide pin, arranged transversely in the interior of the twist tube and is characterized in that at least one terminal part of each thread-guide pin is provided with a coating of at least one solderable metal and is fixed in one bore of the twist tube by soldering. The soldering may be either soft soldering or hard soldering.

The process for the production of this twist tube is characterized in that at least one terminal portion of each thread-guide pin is provided with a coating of at least one solderable metal and is fixed in a bore of the twist tube by soldering at a temperature which neither modifies the crystalline metallic structure of the twist tube nor causes thermal deformation of the same.

As solderable metals for coating the pin ends, preferably nickel, furthermore copper or silver and mixtures of molybdene and manganese may be used. Advantageously, the thread-guide pin may be provided with the metal coating by galvanizing. The very good adherence of this layer which is even sufficient for extremely small parts results on the one hand from mechanical gripping and on the other hand from adhesion forces which are produced by molecular interaction. For soft soldering the soldering temperature may preferably amount to between 200° and 340° C inclusive.

When hard soldering is employed the temperature of the hard soldering lies below the temperature which would cause a modification of the crystalline metallic structure of the twist and/or thermal deformation of the twist tube. The melting temperature preferably lies between 500° and 680° C inclusive.

The twist tube according to the present invention presents excellent, permanent fixation of the thread-guide pin or pins.

DESCRIPTION OF THE DRAWING

In order that the invention may be clearly understood and readily carried into effect an example thereof will now be described with reference to the accompanying drawing wherein.

Figure 1:
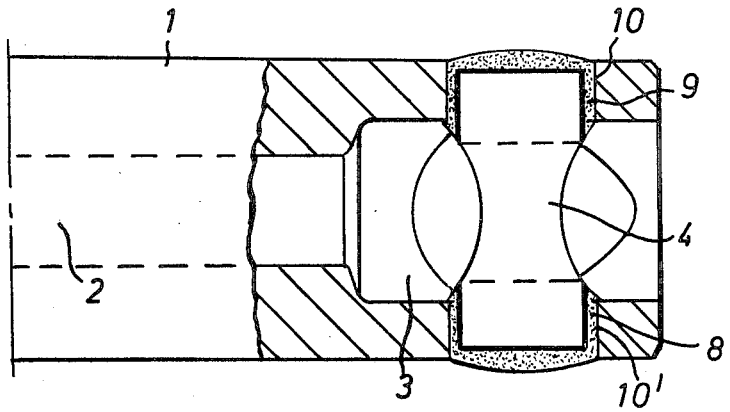
FIG. 1 shows a central longitudinal section through one end of a twist tube and FIG. 2 shows another embodiment of the invention.

The terminal portion of the twist tube consisting of steel has an outer diameter of approximately 2.5 mm and a longitudinal bore 2 having a diameter of approximately 0.5 mm which ends in an enlarged terminal portion having a diameter of approximately 1.5 mm. In the enlarged longitudinal bore 3, and transversely with respect to its axis, there is provided the thread-guide pin 4 which consists of sapphire and the diameter of which, at both ends, is approximately 1 mm and in the central part of reduced diameter, approximately 0.7 mm. The two terminal portions of pin 4 are provided with a nickel coating 8 and permanently fixed in bores 10, 10' by means of soft soldering 9. The soldering is effected at a temperature between 200° and 340° C inclusive.

Figure 2:
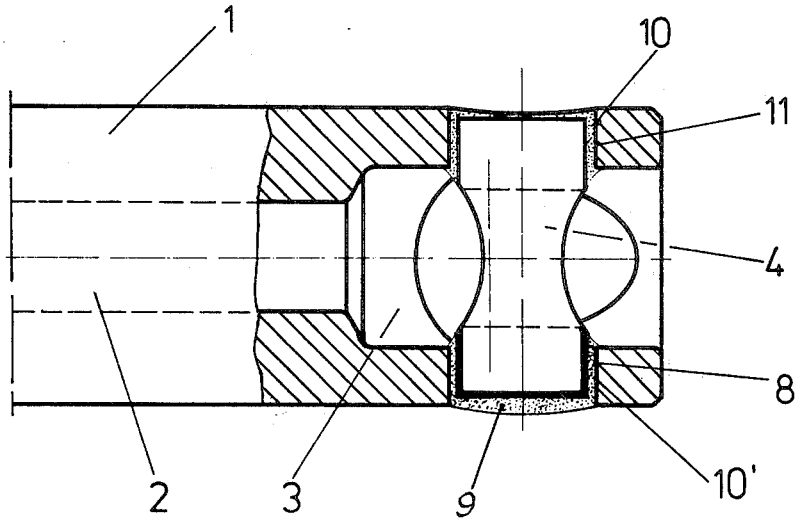

Also other types of twist tube may be used which, at one end of the tube, or in the middle thereof, comprise a portion which is enlarged with respect to the diameter of the tube, containing the thread-guide pin or pins, transversely with respect to the longitudinal axis of the twist tube. The enlarged part of the twist tube through which the pin passes may have an inner diameter of up to 3 mm, which might cause breakage of the thread-guide pin under the effect of the very high yarn tensions occurring at very high revolution speeds. With such twist tubes, it is therefore advantageous as shown in FIG. 2 to solder only one end of the thread guide pin in the corresponding bore and to mount the other end thereof elastically in the other bore by means of synthetic resin material 11.

Where hard solder is used in place of the soft solder 9, the terminal portion or each terminal portion of the thread-guide pin 4 is provided with a coating of at least one solderable metal and is fixed in the associated bore 10 or 10' of the twist tube at a soldering temperature of between 500° and 680° C inclusive, this melting temperature lying below the temperature which would cause a modification of the crystalline metallic structure or a thermal deformation of the twist tube.

I claim:

1. A twist tube for false-twist devices for texturing textile yarns, the twist tube comprising an elongated metal tubular member formed on opposite sides with bores having a common axis perpendicular to the axis of said tubular member, a thread guide pin having terminal portions respectively mounted in said bores, a coating of at least one solderable metal selected from the group consisting of nickel, copper, silver, mixtures of molybdene and manganese provided on at least one of said terminal portions and solder applied between said coating and the interior of the associated bore to fix said terminal portion in said bore.

2. A twist tube according to claim 1, in which said solder is a soft solder.

3. A twist tube according to claim 1, in which said solder is a hard solder having a melting temperature lying below a temperature that would cause a modification of the crystalline metallic structure of the twist tube or a thermal deformation of the twist tube.

4. A twist tube for false-twist devices for texturing textile yarns, the twist tube comprising an elongated metal tubular member having a portion with an enlarged diameter formed on opposite sides with bores having a common axis perpendicular to the axis of said tubular member, a thread guide pin having terminal portions respectively mounted in said bores, a coating of at least one solderable metal selected from the group consisting of nickel, copper, silver, mixtures of molybdene and manganese provided on one of said terminal portions and solder applied between said coating and the interior of the associated bore to fix said terminal portion in said bore, said twist tube being provided in the opposite bore with means for elastically mounting the other pin extremity in said opposite bore.

5. A process for use in the production of a twist tube for false-twist devices for texturing textile yarns comprising an elongated metal tubular member formed on opposite sides with bores having a common axis perpendicular to the axis of said tubular member and a thread guide pin having terminal portions respectively mounted in said bores, said process comprising coating at least one terminal portion of said guide pin with at least one solderable metal selected from the group consisting of nickel, copper, silver, mixtures of molybdene and manganese and soldering said coated terminal portion in the associated bore at a temperature which does not modify the crystalline metal structure of the twist tube nor cause thermal deformation of the twist tube.

6. A process according to claim 5, in which said soldering is soft soldering effected at a temperature that lies between 200° and 340° C inclusive.

7. A process according to claim 5, in which said soldering is hard soldering effected at a temperature that lies between 500° and 680° C inclusive.

8. A twist tube for false twist devices for texturing textile yarns, the twist tube comprising an elongated metal tubular member formed on opposite sides with bores having a common axis perpendicular to the axis of said tubular member, a thread guide pin having terminal portions respectively mounted in said bores, a coating of at least one solderable metal selected from the group consisting of nickel, copper, silver, mixtures of molybdene and manganese provided on at least one of said terminal portions and a hard solder applied between said coating and the interior of the associated bore to fix said terminal portion in said bore, said hard solder having a melting temperature lying below a temperature that would cause a modification of the crystalline metallic structure of the twist tube or a thermal deformation of the twist tube.

* * * * *